US009289883B2

(12) United States Patent
Rieser

(10) Patent No.: US 9,289,883 B2
(45) Date of Patent: Mar. 22, 2016

(54) KNIFE SHARPENER

(71) Applicant: Udo Rieser, Bingen am Rhein (DE)

(72) Inventor: Udo Rieser, Bingen am Rhein (DE)

(73) Assignee: High Tech Ceramic eK (DE)

( * ) Notice: Subject to any disclaimer, the term of this patent is extended or adjusted under 35 U.S.C. 154(b) by 30 days.

(21) Appl. No.: 14/023,522

(22) Filed: Sep. 11, 2013

(65) Prior Publication Data

US 2014/0170941 A1 Jun. 19, 2014

(30) Foreign Application Priority Data

Sep. 28, 2012 (EP) ..... 12006786

(51) Int. Cl.
*B24D 15/08* (2006.01)
*B24B 3/54* (2006.01)

(52) U.S. Cl.
CPC ..... *B24D 15/082* (2013.01); *B24B 3/54* (2013.01); *B24B 3/543* (2013.01)

(58) Field of Classification Search
CPC ..... B24B 3/54
USPC ..... 451/45, 349
See application file for complete search history.

(56) References Cited

U.S. PATENT DOCUMENTS 1,831,863 A * 11/1931 Irwin ..... 451/282
2,114,106 A 8/1936 Geveke
2,504,194 A * 4/1950 Harrington ..... 30/452
2,646,653 A 7/1953 Murchison
2,972,840 A * 2/1961 Ludwig ..... 451/422
3,570,193 A * 3/1971 Barrett ..... 451/349
5,371,977 A * 12/1994 Liner ..... 451/349
2011/0034111 A1 2/2011 Elek et al.
2013/0295824 A1* 11/2013 Hasegawa ..... 451/349

FOREIGN PATENT DOCUMENTS

| | | |
|---|---|---|
| BE | 556718 | 2/1960 |
| DE | 3702751 C2 | 10/1988 |
| DE | 3901127 A1 | 8/1989 |
| EP | 0099382 B1 | 5/1986 |
| WO | 2010101507 A1 | 9/2010 |

OTHER PUBLICATIONS

European Search Report; Application No. EP 12006786; dated Dec. 6, 2012; 4 pages.

* cited by examiner

*Primary Examiner* — Monica Carter
*Assistant Examiner* — Lauren Beronja
(74) *Attorney, Agent, or Firm* — Thomas, Karceski & Karmilovich, P.C.

(57) ABSTRACT

In a knife sharpener with two whetting disks (2, 3) which are rotatably mounted about the same axis of rotation (8), oppose each other and have whetting surfaces (11, 12) facing each other, which between themselves form a sharpening slot (13) which widens outwards in radial direction, and with a housing (4) which surrounds the whetting disks (2, 3) and above the sharpening slot (13) includes a knife guiding slot (24) which extends at an angle (α) to the sharpening slot (13), at least a first one of the whetting surfaces (11) is formed convex and the second whetting surface (12) is formed linear or likewise convex in radial direction.

3 Claims, 1 Drawing Sheet

KNIFE SHARPENER

The present application claims priority to European Patent Application Serial No. 1200067863 filed Sep. 28, 2012 and incorporated by reference herein in its entirety.

This invention relates to a knife sharpener with two whetting disks which are rotatably mounted about the same axis of rotation, oppose each other and have whetting surfaces facing each other, which between themselves form a sharpening slot which widens in radial direction to the outside, and with a housing which surrounds the whetting disks and above the sharpening slot has a knife guiding slot which extends at an angle to the sharpening slot.

Such knife sharpener is known for example from DE 43 41 872 A1. The knife sharpener described and illustrated there includes two frustoconical whetting disks which between themselves form a V-shaped sharpening slot. Since the sharpening slot and the knife guiding slot extend at an angle to each other, the knife blade, when it protrudes through the knife guiding slot into the sharpening slot, rests against the one whetting disk with the one blade side and against the other whetting disk with the other blade side. When pulling the knife blade through the guiding and the sharpening slot, the whetting disks are put into a rotary movement and produce a grinding extending substantially transversely to the cutting edge—e.g. at an angle of 70°. The rotary movement of the two whetting disks can also be blocked, so that when pulling the knife blade through the guiding and the sharpening slot a longitudinally extending grinding is made. With a longitudinally extending grinding, possible notches can be eliminated and a certain basic sharpness can be achieved; such grinding is referred to as rough grinding. With the substantially transversely extending grinding, the final sharpness is achieved; this grinding is referred to as fine grinding. The grinding angle in thickness direction of the knife blade corresponds to the angle of inclination of the conical surfaces which form the sharpening slot. All knives therefore are ground with the same grinding angle. An adaptation to different requirements is not possible.

From DE 39 01 127 A1 there is also known a knife sharpener of the type mentioned above. In this knife sharpener, the two whetting disks rotatably mounted on a shaft are, or the shaft is, pivotable about an end of the shaft such that the shaft forms an angle with respect to the sharpening direction of the knife, i.e. with respect to the longitudinal axis of the guiding slot, which angle in the one end position of the shaft is smaller and in the other end position greater than 90°. It thereby is avoided that one side of the knife blade at the free end of the blade and at the handle end of the blade remains unground. The two whetting disks here as well are truncated cones which between themselves form a V-shaped sharpening slot.

It is the object of the invention to improve a generic knife sharpener such that knives can be ground with it more properly as needed.

According to the invention, this object is solved with a knife sharpener of the type mentioned above in that in radial direction at least a first one of the whetting surfaces is formed convex and the second whetting surface is formed linear or likewise convex.

With a knife sharpener according to the invention every knife blade can be ground in its thickness direction with a grinding angle corresponding to the technical requirements or according to the wishes of the user. Due to the fact that at least one of the two whetting surfaces is formed convex in radial direction, the grinding angle on this side of the knife blade is dependent on the height at which the knife blade is located in the sharpening slot. Since the sharpening slot widens in radial direction to the outside from the slot bottom, the grinding angle with respect to a plane vertical to the axis of rotation is smallest in the slot bottom. This means, the deeper a knife blade protrudes into the sharpening slot, the smaller or more acute the grinding angle. With the choice of the height at which the knife blade is located in the sharpening slot, the grinding angle with which the knife blade should be ground can now be chosen. By suitable adjustment of the convex shape to the angle between knife guiding slot and sharpening slot, the opening width of the sharpening slot, which lies in the projection of the knife guiding slot, is fixed along the convex shape. This means, it is fixed to which height which opening width with which grinding angle should belong. In this way it is determined with which grinding angle a knife blade is ground in dependence on its thickness, when the knife blade is put into the sharpening slot as deep as possible.

Preferably, the convex shape is formed as polygonal line. In this embodiment, a whetting surface includes at least two annular whetting surface portions coaxial to the axis of rotation, which with the opposed other whetting surface form sectionally increasing opening angles in radial direction to the outside, wherein in radial direction to the outside the at least one second and each further whetting surface portion with respect to the previous whetting surface portion extends with an inclination towards the side facing away from the previous opening angle. With these measures, a convex shape can be manufactured at low cost.

In another, likewise preferred embodiment of the invention the convex shape is formed as continuous curve. This provides for a very fine adjustment of the grinding angle by corresponding choice of the height in the sharpening slot and hence of a certain circular arc on the convex shape with the desired tangent inclination—i.e. with the desired grinding angle.

In a favorable development of the invention, the two whetting surfaces are formed mirror-symmetrical to each other and rotationally symmetrical to the axis of rotation. In this way, the knife blade is ground identically on both sides and along the entire blade length.

In an advantageous aspect of the invention, both whetting surfaces with a symmetrical formation in the form of a polygonal line have at least one first and one second whetting surface portion, which oppose each other and extend outwards in radial direction each over at least one third of the grinding slot height and each form an angle of inclination to the central plane of the sharpening slot in the range from 13° to 17° and from 18° to 22°, respectively. With a knife sharpener formed in this way, a large variety of commercially available knives already can be ground easily under almost optimum conditions.

In a likewise preferred embodiment, in whetting surfaces whose convex shape is a continuous curve and which are formed symmetrical to each other, the tangents in radial direction to the outside at about one third of the sharpening slot height each have an angle of inclination to the central plane of the sharpening slot in the range from 13° to 17° and at about two thirds of the sharpening slot height in the range from 18° to 22°. Because of the possible fine gradings, largely all commercially available knife blades can be ground optimally with such knife sharpener.

Preferably, the angle between knife guiding slot and sharpening slot is adjustable. As a result, the assignment of opening width to height within the sharpening slot and hence to the grinding angle is variable. In this way, the maximum depth with which a knife blade can protrude into the sharpening slot in dependence on its thickness, and hence the minimum possible grinding angle for a given blade thickness, is adjusted.

The angle between knife guiding slot and sharpening slot preferably is adjustable in a range from 5° to 25°. With this range, the maximum possible penetration depth of a knife blade into the sharpening slot and hence also the grinding angle present there can be adjusted in a range which covers the known requirements and needs when grinding knives.

The invention will subsequently be explained in greater detail by way of example with reference to the drawings, in which.

Figure 2:
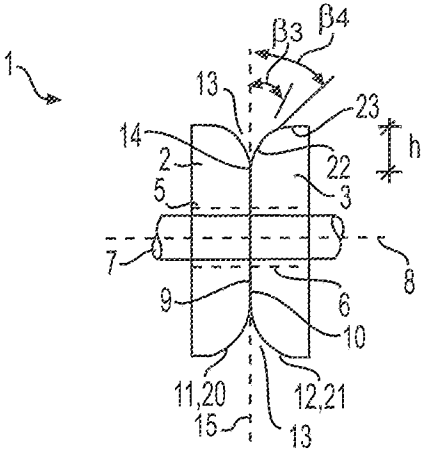
FIG. 2 shows a representation similar to FIG. 1 of a second embodiment of a knife sharpener according to the invention.

The embodiments of a knife sharpener 1 according to the invention as shown in the Figures include two whetting disks 2, 3 and a housing 4 in which the two whetting disks 2, 3 are arranged.

The two whetting disks 2, 3 each have a central through opening 5, 6, through which a common shaft 7 extends. The whetting disks 2, 3 oppose each other on the shaft 7 and are non-rotatably connected with the same. The shaft 7 itself is rotatably mounted in the housing 4 about an axis of rotation 8.

In its region adjoining the through opening 5, 6, the two whetting disks 2, 3 have surfaces 9, 10 which extend vertically to the shaft 7, rest against each other and are bonded to each other.

The two whetting disks 2, 3 have whetting surfaces 11, 12 facing each other, which between themselves form a circumferential annular gap or sharpening slot 13. The sharpening slot 13 monotonously widens in radial direction to the outside from the slot bottom 14. The opposed whetting surfaces 11, 12 are convex and formed symmetrical to a plane 15 which extends vertically to the axis of rotation 8 through the slot bottom 14. This plane 15 also is referred to as central plane of the sharpening slot 13. In direction of rotation or circumferential direction of the whetting disks 2, 3 the whetting surfaces 11, 12 are formed rotationally symmetrical.

Figure 1:
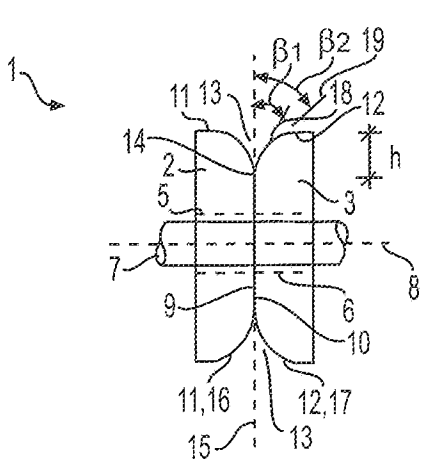
FIG. 1 shows a schematic representation with enlarged scale in horizontal direction of two whetting disks of a first embodiment of a knife sharpener according to the invention.

In the embodiment shown in FIG. 1, the whetting surfaces 11, 12 are formed in the form of a continuous convex curve 16, 17. In the illustrated exemplary embodiment, the curves 16, 17 have a tangent 18 in radial direction to the outside at one third of the sharpening slot height h, which is inclined at an angle $\beta_1$ of about 15° with respect to the central plane 15, and at two thirds of the sharpening slot height h a tangent 19, which is inclined at an angle $\beta_2$ of about 20° with respect to the central plane 15.

In the embodiment shown in FIG. 2, the convex shape of the whetting surfaces 11, 12 is formed by a polygonal line 20, 21. In the illustrated exemplary embodiment, the polygonal line 20, 21 consists of two circular ring surfaces 22, 23 adjoining each other and extending in direction of rotation, which are inclined differently to the central plane 15 of the sharpening slot 13. In the example shown in FIG. 2, the radially inner circular ring surface 22 is inclined by an angle $\beta_3$ of about 15°, and the radially outer circular ring surface 23 is inclined by an angle $\beta_4$ of about 20° to the central plane 15 of the sharpening slot 13. The radially inner circular ring surface 22 for example extends over the lower half of the sharpening slot 13, and the radially outer circular ring surface 23 over the upper half of the sharpening slot 13.

Figure 4:
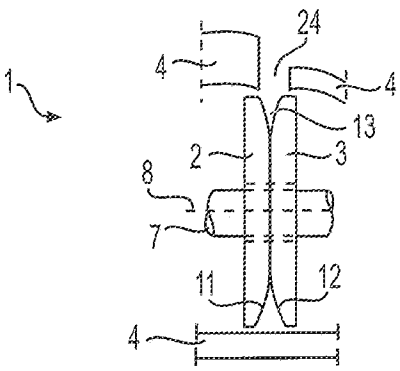
FIG. 4 shows a schematic representation of a sectional view along line IV-IV of FIG. 3.
Figure 3:
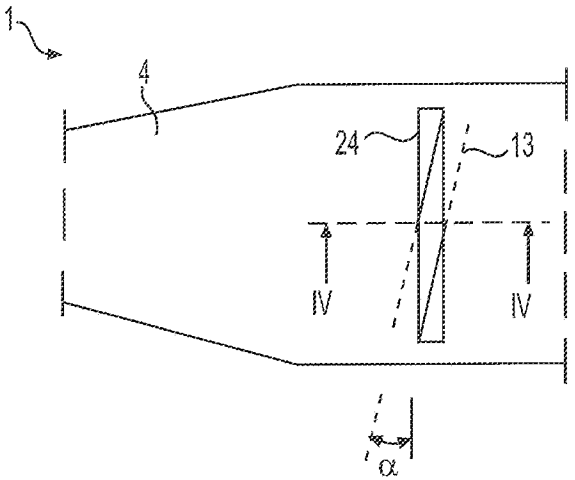
FIG. 3 shows a schematic representation of a top view of a segment of an embodiment of a knife sharpener according to the invention, with guiding slot and sharpening slot.

As shown in FIGS. 3 and 4, a guiding slot 24 is arranged above the sharpening slot 13 in the housing 4. The width of the guiding slot 24 approximately corresponds to the opening width of the sharpening slot 13 at its radially outer end and is constant along the length of the guiding slot 24.

In the top view (FIG. 3), guiding slot 24 and sharpening slot 13 are inclined to each other by an angle of inclination $\alpha$, which in the illustrated exemplary embodiment is about 14°. The angle of inclination $\alpha$ can be adjustable to a desired magnitude within a specified range by means of a suitable adjusting device, in that due to the rotatability either of the housing 4 or of a housing part the location of the guiding slot 24 is variable or the location of the sharpening slot 13 is variable by pivoting the shaft 7 vertically to its axis of rotation 8, or by a combination of both measures. By means of a locking device, the housing 4 or housing part and the whetting disks 2, 3 then can be locked in the desired adjusted angular position a to each other, so that when reciprocating the knife blade, they (2, 3, 4) do not change their position relative to each other.

With a given convex shape and opening width of the sharpening slot 13, that circular arc on the whetting surfaces 11, 12 is determined by the angle of inclination $\alpha$ between guiding slot 24 and sharpening slot 13, on which a knife blade with given thickness is ground. With an adjustment of the angle of inclination $\alpha$ between guiding slot 24 and sharpening slot 13, this circular arc can be varied with changing requirements. What is conceivable, for example, is an adjustability in the range from 5° to 25°.

The invention claimed is:

1. A knife sharpener, comprising:

two whetting disks (2, 3) which are rotatably mounted about the same axis of rotation (8), oppose each other and have side faces (9, 11; 10, 12) facing each other, the side faces (9, 11; 10, 12) having whetting surfaces (11, 12) which between themselves form a sharpening slot (13) which widens outwards in a radial direction, and comprising;

a housing (4) which surrounds the whetting disks (2, 3) and above the sharpening slot (13) includes a knife guiding slot (24) which extends at an angle ($\alpha$) to the sharpening slot (13), and wherein in the radial direction at least a first one of the whetting surfaces (11) is formed in a convex shape and the second whetting surface (12) is formed in a linear or convex shape, wherein the convex shape is formed as a polygonal line (20, 21), wherein both whetting surfaces (11, 12) have at least one first and one second whetting surface portion (22, 23), which oppose each other and extend outwards in the radial direction each over at least one third of the sharpening slot height (h) and each form an angle of inclination ($\beta_3$, $\beta_4$) to the central plane (15) of the sharpening slot (13) in the range from 13° to 17° and from 18° to 22°, respectively.

2. The knife sharpener according to claim 1, wherein the two whetting surfaces (11, 12) are formed mirror-symmetrical to each other and rotationally symmetrical to the axis of rotation (8).

3. A knife sharpener, comprising:

two whetting disks (2, 3) which are rotatably mounted about the same axis of rotation (8), oppose each other and have side faces (9, 11; 10, 12) facing each other, the side faces (9, 11; 10, 12) having whetting surfaces (11, 12) which between themselves form a sharpening slot (13) which widens outwards in a radial direction, and comprising;

a housing (4) which surrounds the whetting disks (2, 3) and above the sharpening slot (13) includes a knife guiding slot (24) which extends at an angle ($\alpha$) to the sharpening slot (13), and wherein in the radial direction at least a first one of the whetting surfaces (11) is formed in a convex shape and the second whetting surface (12) is formed in a linear or convex shape, wherein the convex shape is formed as a continuous curve (16, 17), wherein with both whetting surfaces (11, 12) the tangents (18) in the radial direction to the outside at one third of the sharpening slot height (h) each have an angle of inclination ($\beta_1$) to the central plane (15) of the sharpening slot (13) in the range from 13° to 17°, and the tangents (19) at two thirds of the sharpening slot height (h) each have an angle of inclination ($\beta_2$) in the range from 18° to 22°.

* * * * *